US006520216B2

(12) United States Patent
Corbiere

(10) Patent No.: US 6,520,216 B2
(45) Date of Patent: Feb. 18, 2003

(54) PROCESS FOR OBTAINING A WOVEN CLOTH

(75) Inventor: Claude Corbiere, La Tour de Salvagny (FR)

(73) Assignee: Cortex S.A., Sainte Consorce (FR)

( * ) Notice: Subject to any disclaimer, the term of this patent is extended or adjusted under 35 U.S.C. 154(b) by 5 days.

(21) Appl. No.: 09/948,980

(22) Filed: Sep. 7, 2001

(65) Prior Publication Data

US 2002/0059961 A1 May 23, 2002

Related U.S. Application Data

(63) Continuation of application No. PCT/FR00/00567, filed on Mar. 8, 2000.

(30) Foreign Application Priority Data

Mar. 10, 1999 (FR) ..... 99 03124
Mar. 10, 1999 (FR) ..... 99 03125

(51) Int. Cl.[7] ..... D03D 41/00; D03D 9/00
(52) U.S. Cl. ..... 139/1 R; 139/11; 139/35; 68/50; 8/471; 101/470; 101/172
(58) Field of Search ..... 139/1 R, 11, 35; 68/5 D; 101/172, 470; 8/47

(56) References Cited

U.S. PATENT DOCUMENTS 4,024,003 A 5/1977 Buhler
5,212,845 A 5/1993 Corbiere
5,377,509 A 1/1995 Corbiere
6,050,303 A 4/2000 Corbiere
6,105,624 A * 8/2000 Wildeman et al. ..... 101/481
6,328,078 B1 * 12/2001 Wildeman et al. ..... 101/481

FOREIGN PATENT DOCUMENTS

| | | |
|---|---|---|
| CA | 1 124 049 | 5/1982 |
| DE | 28 40 179 | 3/1980 |
| EP | 0 461 048 A1 | 12/1991 |
| FR | 1.433.270 | 2/1966 |
| FR | 2 751 350 | 1/1998 |
| JP | 59026550 | 2/1984 |

* cited by examiner

*Primary Examiner*—John J. Calvert
*Assistant Examiner*—Robert H. Muromoto
(74) *Attorney, Agent, or Firm*—Heslin Rothenberg Farley & Mesiti P.C.

(57) ABSTRACT

A method for obtaining a woven fabric which comprises continuously unwinding from a single warp beam, a set of parallel warp yarns; passing the set of warp yarns on a whip-roll; forming a shed using heald means; inserting a weft yarn in the shed in the proximity of a face stitch to form a fabric; and finally uniformly pulling and batching the resulting fabric. In one aspect of the invention, the method consists of, in the proximity of the shed opening stitch, heating the warp yarns, and then cooling said warp yarns in the shed before they reach the heald means, characterized in that only part (34) of the warp yarns is heated. In one aspect of the invention, the shed may be defined in the forward movement direction of the warp, for example, by the opening stitch and the face stitch.

26 Claims, 5 Drawing Sheets

PROCESS FOR OBTAINING A WOVEN CLOTH

CROSS REFERENCE TO RELATED APPLICATIONS

This application is a continuation of PCT application PCT/FR00/00567 filed on Mar. 8, 2000, which claimed the priority of French application FR 99.03125 filed Mar. 10, 1999 and French application FR 99.03124 filed Mar. 10, 1999.

TECHNICAL FIELD

The invention relates to the field of the textile industry. It relates more specifically to the production of fancy fabrics used for garments or the like. It relates more particularly to improvements made to weaving processes combined with warp-yarn treatment operations. It also relates to the cloth thus obtained, which has novel patterns.

PRIOR ART

As is known, certain fancy fabrics have patterns which consist of juxtaposed warp yarns of a different nature or having different properties. When manufacturing such a fabric, it is therefore necessary for the warp yarns to come from two, or even more, different warp beams. Thus, the yarns coming from two warp beams form two parallel sheets which are mixed at the feed bars before they enter the shed-forming region. The two warp beams are needed to allow the sheets of yarns, which are either of a different nature or have undergone different pretreatments, such as dyeing, to advance differently.

Thus, the problem of managing multiple warp beams arises in several types of fancy fabric such as, in particular, cloth having a particularly novel appearance, similar to cotton crepe cloth more generally called "seersucker".

Also encountered is the problem of managing a large number of warp beams in the production of striped fabrics.

This is because, in both cases, when it is desired to combine within one and the same warp beam several types of yarns which are either of a different nature or of a different shade, this involves operations prior to weaving which are irksome or even impossible when the warp yarns to be combined are of a very different nature. Furthermore, when the various yarns are combined within one and the same warp beam, their spread and distribution are set, so that it is impossible to modify the number and width of each of the regions of specific properties.

Thus, for example, the width of the stripes is determined intangibly by the spread of the yarns of the shades used. In other words, it is necessary to have a warp beam specific to the production of each pattern. Obviously this is extremely expensive and results in the loss of time when it is desired to change patterns.

The problem is not solved when two different warp beams each comprising one type of yarn are used. This is because the mechanism allowing two yarns coming from two different warp beams to be combined, at a feed bar, into a single sheet allows only one specific type of mixing and a given and set distribution of the yarns coming from these two warp beams to occur. In other words, the looms used for producing such articles are not completely versatile but, on the contrary, are often dedicated to the production of a single type of fabric.

One of the objectives of the invention is to allow fancy fabrics chosen from a wide variety to be produced by means of a single loom which is as simple as possible and carries a single warp beam formed from a single grade of yarn.

SUMMARY OF THE INVENTION

The invention therefore relates to a process for obtaining a woven cloth. This process comprises, in a known manner, the following steps in which:

- a sheet of parallel warp yarns is continuously unwound from a single warp beam;
- said sheet is made to pass over a back-rest roller;
- a shed is formed by means of healds, said shed being defined, in the direction of advance of the warp, at the entrance of the shed by an opening point and on the other side by a fell point;
- a weft yarn is inserted into the shed in the vicinity of the fell point in order to form a cloth; and
- finally, the cloth thus formed is pulled uniformly and wound up;
- and in which, in the vicinity of the opening point of the shed a heating operation is carried out on the warp yarns and then said warp yarns are cooled in the shed before they reach the healds.

The process according to the present invention is characterized in that the heating operation is carried out on only a portion of the warp yarns.

In other words, the process according to the invention treats a portion of the warp yarns differentially. This means that, over the total width of the fabric, only a portion of these warp yarns undergoes the heating step which gives them specific properties.

Thus, if the heating operation is carried out on the warp yarns at a temperature high enough to cause an elongation and a local reduction in the elastic modulus, the fabric thus obtained has warp yarns which come from a single beam, delivering uniform yarns, but which are differentially converted during the weaving operation. Consequently, when the fabric obtained undergoes a subsequent shrinking step, the warp yarns behave in a different manner according to whether or not they have undergone the heat treatment during weaving. It follows that the different lengths of the warp yarns and the complementary shrinkage phenomenon cause, within the fabric, different deformations which are distributed according to the selection of the warp yarns that have or have not undergone the heating operation during weaving. This is because those yarns which have undergone the heat treatment during weaving have a lower shrinkage than those which have not been heated, and result in the appearance of embossed regions through the thickness when the unheated yarns shrink. The effects thus obtained are highly pronounced and vary according to the yarns used.

In practice, using the process according to the invention, the sheet is separated, downstream of the back-rest roller, into two series of yarns and a gap is maintained between the two series of warp yarns in order to subject only one of the two series to the characteristic heating operation. In this way, by means of two single lease rods, the sheet is divided according to the desired geometry, by selecting the number and the position of the yarns which have to be heated under tension. Thanks to the simplicity of the separating mechanism, it is possible to vary without any difficulty the distribution between the two series resulting from the sheet by selecting at will the desired distribution. For example, it may be chosen to heat only a fewer number of warp yarns, keeping a larger number of yarns unheated, which will then undergo a greater shrinkage. Conversely, it may be chosen to heat most of the warp yarns in order to obtain yet other effects.

The configuration of each of the series may also be chosen according to the wish of the user, and without any restriction, with the possibility of obtaining effects which vary over the width of the fabric. Thus, it is possible to create each series of warp yarns by using numbers of identical yarns assembled in groups or in bundles. It is also possible to vary the number of yarns per bundle over the width of the fabric, and to do so with complete freedom of choice.

In practice, the process according to the invention may advantageously furthermore include a heat treatment step "in the free state". This treatment may advantageously be a scalding treatment or a hot-air treatment, without any tensile stress, such as may be obtained on continuous machines called "tumblers". Thus, by forcing the shrinkage in the free state, the difference in behavior between those yarns which have undergone the heating operation and the others is accentuated, thereby causing more pronounced volume deformations. In one advantageous way of implementing the process, the shrinkage step may be followed by a calendering step, or more generally by a step in which the patterns formed are flattened, in order to give a different and flattering external appearance.

The invention also relates to the textile cloth which is obtained by means of the process according to the invention and which has an appearance similar to seersucker fabrics.

In practice, the warp yarns used may advantageously be crepe yarns and/or textured crepe yarns, that is to say crepe yarns that have undergone a twisting step and a false-twisting step. It is also possible to vary the effects within the fabric using different and lathed weft yarns.

As already stated, the cloth obtained may have extremely varied effects depending on whether the yarns which have undergone the heat treatment during weaving are in equal number or greater or lesser in number than those which have retained their shrinkability without having been heated. Furthermore, the effects may also be varied by choosing, within the series of warp yarns to be heated, bundles having either a uniform distribution or a variable distribution according to the choice of the manufacturer.

The process according to the invention may also prove to be advantageous for producing patterns on the warp yarns from a transfer paper. Thus, more specifically, according to this particular method of implementing the process:

- only that portion of the warp yarns which undergoes the heating operation is brought into contact with a transfer paper carrying dye patterns, which can be transferred onto the warp yarns owing to the effect of said heating operation;
- said transfer paper is made to run in a speed relationship with the speed of advance of the sheet of warp yarns, so that transfer of the dye pattern takes place only on just said portion of the warp yarns which undergoes the heating operation.

In other words, the invention consists in separating the sheet of warp yarns from the yarns intended to receive the printing in order to form bundles of yarns on which the patterns present on the transfer paper are printed, and which yarns form, when they are assembled with the other yarns of the sheet, the characteristic stripes. Consequently, only the yarns forming the stripes on the fabric are printed and the boundaries of the stripes on the fabric are perfectly well defined within one and the same yarn. The stripes are therefore perfectly straight. Yet it is known that, in conventional printing processes involving transfer from paper having stripes, the boundary between two stripes from the paper is not always located on one and the same yarn but, on the contrary, tends to move about and be distributed over several yarns, constituting a uniformity defect.

Furthermore, it has been found that, surprisingly, those yarns located at the lateral edges of stripes receive a surplus of dye during printing and have a greater intensity of color than the rest of the band. This overintensity enhances the boundary of the stripe, giving a particularly perceptible crimp effect.

In practice, when it is desired to obtain stripes of uniform width, each of the series of warp yarns is defined in such a way that they consist of bundles of yarns, each bundle having a similar number of yarns. Of course, the invention is not limited to this method of implementation alone but also allows stripes of whatever dimensions to be obtained, by selecting, in a uniform or nonuniform manner, and with complete freedom, the number of yarns which will undergo the printing step. A very wide variety can thus be obtained since it is possible to select yarn by yarn, and to obtain, in the extreme case, stripes limited to only a single yarn widthwise.

It is possible to multiply the effects, especially by selecting a transfer paper which has a pattern of parallel stripes in the direction of run of the paper, such that one of the boundaries between said bands is brought close to that portion of the warp yarns on which the printing takes place. In other words, on the same stripe obtained by selecting a portion of warp yarns, it is possible to print an additional pattern, itself consisting of stripes, these possibly moving about owing to the variation in the mixing of the two neighboring colors.

As already stated, the invention also relates to the cloth which is woven according to the invention and has a plurality of parallel stripes. As already stated, it is found that each stripe thus has a selvedge, the intensity of the shade of which is higher than the rest of the stripe.

BRIEF DESCRIPTION OF THE FIGURES

The manner of implementing the invention and the advantages which stem therefrom will become clearly apparent from the description of the methods of implementation which follow, in which.

WAYS OF IMPLEMENTING THE INVENTION

As already stated, the invention relates to a weaving process which treats the warp yarns in a differential manner. It may have several applications, and especially two main applications, namely the production of seersucker-type fabrics, which will be described first, and the production of striped fabrics, which will be described secondly.

First Way of Implementing the Invention

In this first application, the weaving process is intended to be applied to warp yarns generally having a high elastic modulus.

This process may be carried out on a conventional loom equipped with components allowing a heat treatment to be carried out on the warp yarns while they are being tensioned by the fabric take-up roller of the loom, and as the Applicant has described this in patent FR 2 751 350.

Such a loom also comprises particular arrangements allowing the characteristic cloth of the invention to be produced.

Figure 1:
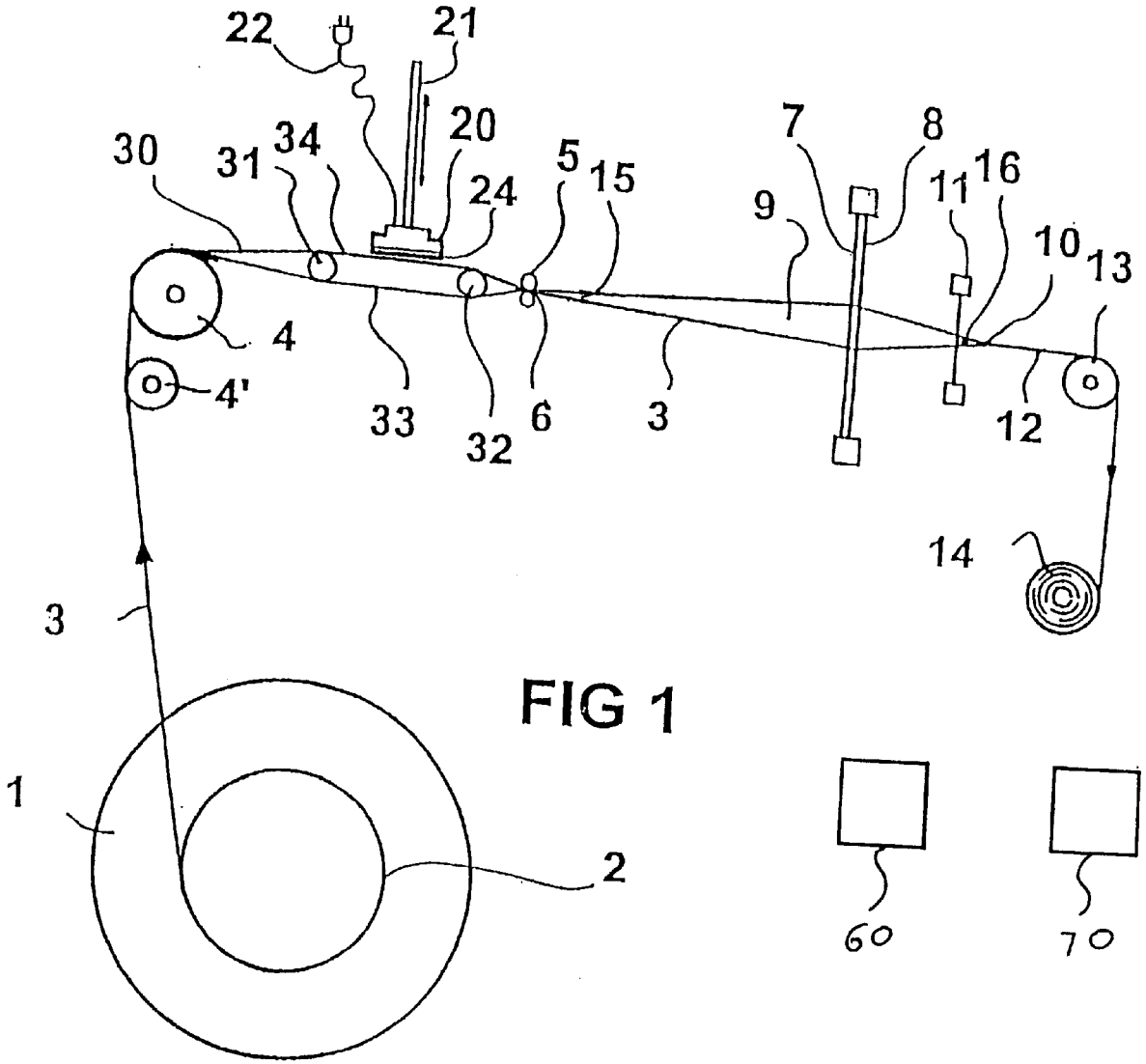
FIG. 1 is a side view of a loom operating using the process according to the invention, shown in its application to the production of seersucker-type fabrics.

Thus, as illustrated in FIG. 1, a loom has, in the direction of run of the yarn, a warp beam (1) which is mounted on a shaft (2) and on which all the parallel warp yarns are wounded.

These warp yarns (3) are unwound from the warp beam (1) as far as a back-rest roller (4), on which they assume an approximately horizontal direction.

To get past the characteristic region of the invention described below, the warp yarns (3) pass right through two lease rods (31, 32). After these lease rods (31, 32), they are brought back together again in a single sheet by the guides (5, 6). They are then taken up by healds (7, 8), the purpose of which is to move the various warp yarns (3) upward or downward in order to form the shed (9) and to allow the weft yarn (16) to be inserted. The reference number (15) denotes the opening point of the shed.

After the healds (7, 8), the warp yarns meet again at the fell point (10), onto which the comb (11) beats up after each reopening of the shed. Beyond the fell point, the fabric (12) thus formed passes via various transfer rollers (13) before ending up at the winding system (14), As already stated, the invention consists in heating only a portion of the tensioned warp yarns in the vicinity of the opening point of the shed, in order to reduce their elastic modulus and, where appropriate, to allow them, owing to the action of the loom, to undergo intermittent stretching just before the actual weaving.

Thus, various means may be suitable for providing this heating.

In the method of implementation illustrated, there is a heating pad (20) which is present over the entire width of all of the warp yarns and which can come into contact with a portion of the sheet of warp yarns between the lease rods (31, 32).

More specifically, there is a transverse heating element, the underside of which is covered with a material having a very high surface hardness and a low friction coefficient in order to prevent any abrasion by the warp yarns, which would cause subsequent damage to the warp yarns themselves.

There may especially be an outer anodized or chromium-plated or ceramic coating (24).

Of course, the invention embraces all types of heating of the pad, and especially those using electrical energy by means of suitable connections (22).

As already stated, according to an essential characteristic of the invention, only a portion of the tensioned warp yarns undergoes the heat treatment owing to the pad.

Thus, as illustrated in FIG. 1, downstream of the back-rest roller (4), the loom has at least one lease rod (31) allowing the sheet (30) to be separated into two series, namely a series (34) passing over the bar (31), and therefore intended to come into the vicinity of the pad (20).

Conversely, the other series (33) passes beneath the bar (31), and is therefore further away from the pad (20) than the series (34).

The two series (33) and (34) follow parallel paths until they reach the second lease rod (32) marking the end of the region of separation of the two series (33, 34).

Depending on the distribution of the various bundles forming the two series, a distribution, within the final fabric, of yarns capable of shrinking and of elongated and already set yarns is obtained.

FIG. 1 also illustrates the optional heat treatment step (60) and the optional calendaring step (70).

Figure 2:
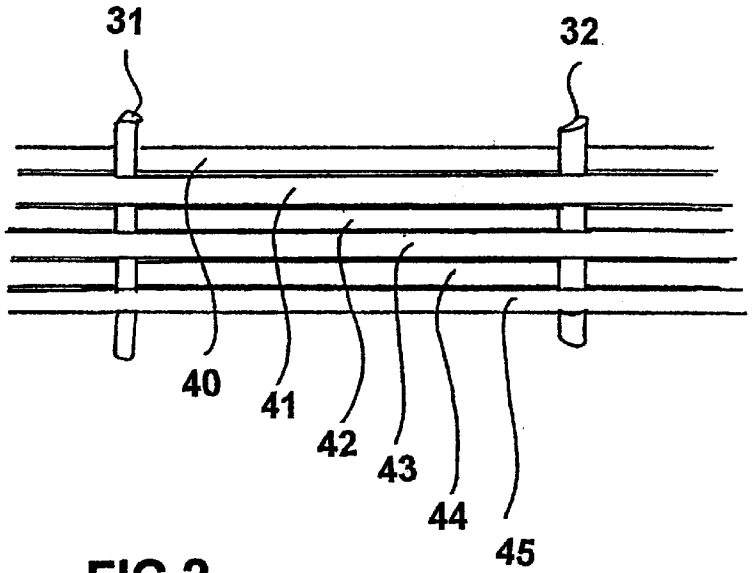
FIG. 2 is a top view of the sheet in the characteristic region of the invention, in which the heating operation is carried out prior to the actual weaving.

FIG. 2 illustrates a distribution of these yarns within each of the series.

Thus, as illustrated schematically, the series of yarns running through the characteristic region, being further away from the pad, is split into several bundles (40, 42, 44) passing beneath the bars (31) and (32).

Conversely, the bundles (41, 43, 45) themselves pass over the bars (31, 32) and therefore follow a path running close to the pad.

In FIG. 2, the various bundles (40, 45) have identical widths, thereby resulting in the final product in deformations distributed uniformly approximately in a uniform checker board arrangement.

Figure 3:
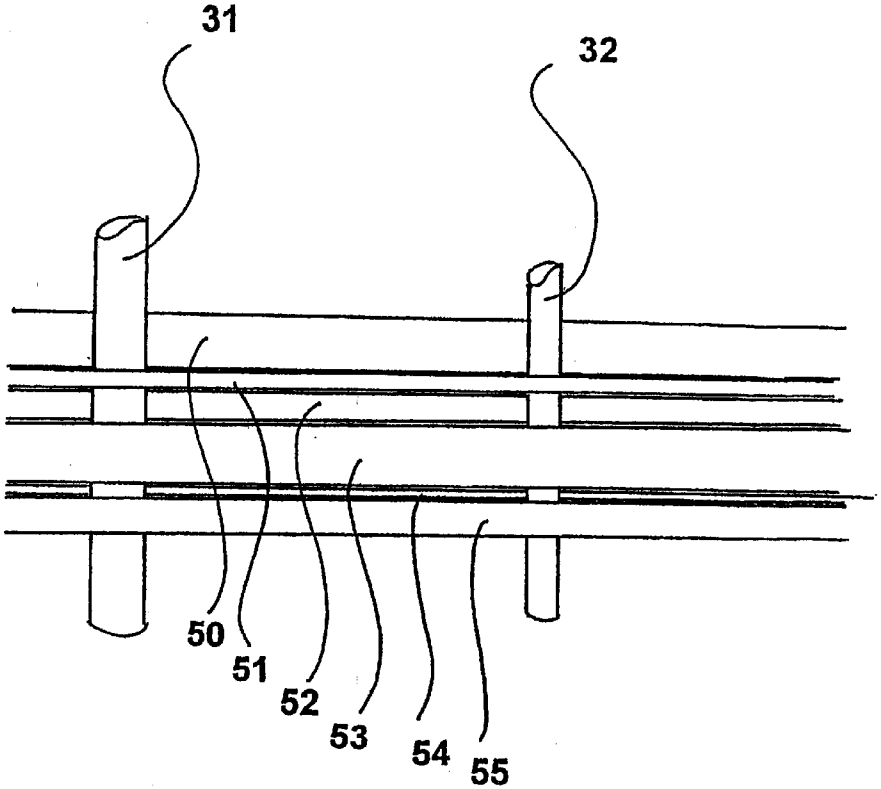
FIG. 3 is a top view of the same region, but with a different distribution of the two series of warp yarns.

On the other hand, the splitting of the sheet according to the diagram in FIG. 3, in which the various bundles (50, 55) all have different widths, results in different effects distributed over the finished fabric, producing particular patterns, As indicated in the Applicant's document FR 2 751 350, the pad may be combined with any advantageous device allowing damage or even melting of the yarns to be prevented when the advance of the yarns is stopped.

Furthermore, various types of heating may also be adopted.

A cloth based on warp yarns made of polyester, with linear density of 50 decitex, containing 36 strands, twisted with 1300 turns per meter, and having undergone beforehand a false-twisting step, was produced according to the process of the invention.

Thus, this textured crepe warp yarn was woven with weft yarns, also 50 decitex/36 strand polyester yarns, but twisted with 750 turns per meter.

Figure 4:
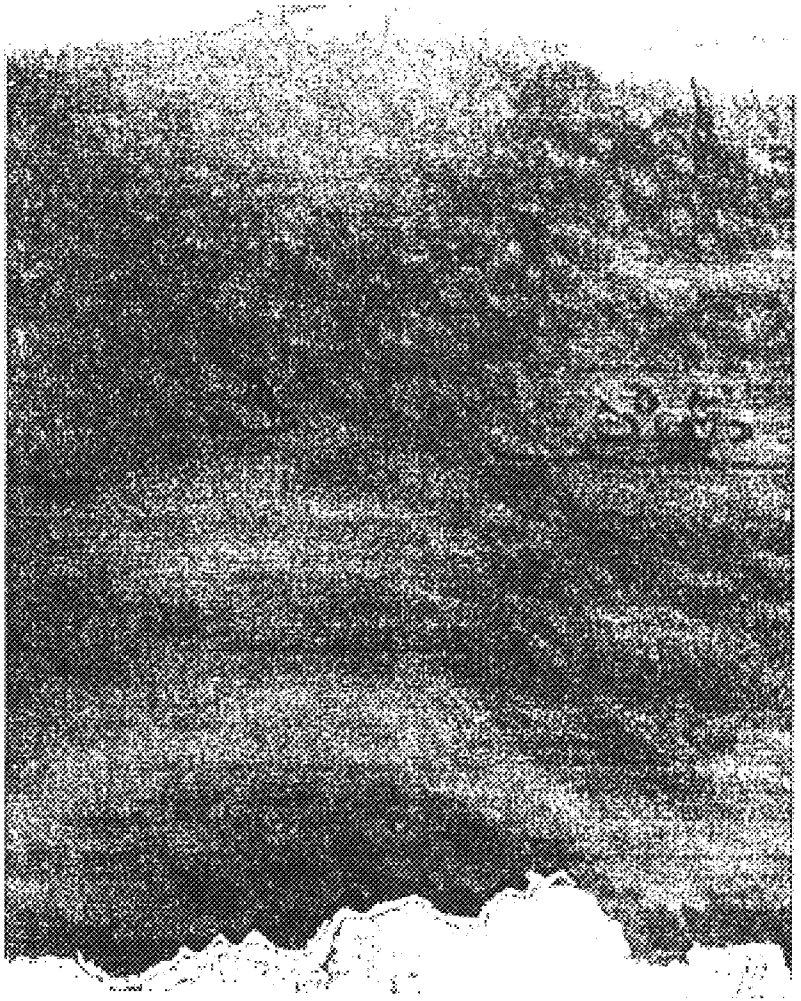
FIG. 4 is a photograph of a fabric of the seersucker type, obtained according to the invention.

Using a heating pad allowing the temperature to rise up to about 220° C., the fabric whose photographic reproduction is shown in FIG. 4 was obtained. Such a fabric has multiple depressed and raised regions which are formed by a differential length of the yarns and accentuated by the differential shrinkage of the various regions of the fabric.

This shrinkage is further accentuated by carrying out a subsequent heat treatment in the free state, such as a scalding treatment.

Figure 5:
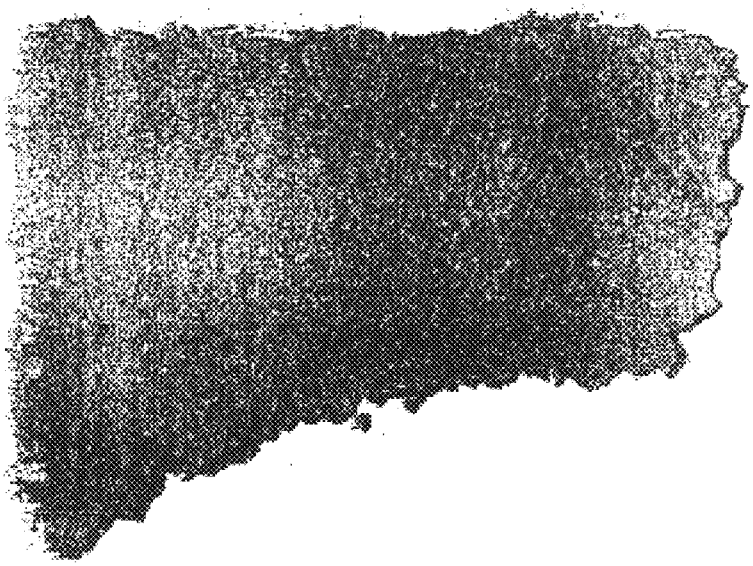
FIG. 5 is a photograph of the fabric shown in FIG. 4, which has undergone a calendering step.

The effects obtained may also have a greater variety by carrying out an additional calendering or ironing step allowing the various patterns to be flattened, as shown in the photograph in FIG. 5.

It is apparent from the foregoing that the process according to the invention makes it possible to obtain cloth having a particularly attractive and novel appearance, with multiple raised and depressed regions in the manner inter alia of seersucker fabrics.

Modifying the width of each bundle (40–45; 50–55) is a particularly easy operation to carry out. This increases the easy versatility of the process according to the invention.

Second Way of Implementing the Invention

Figure 6:
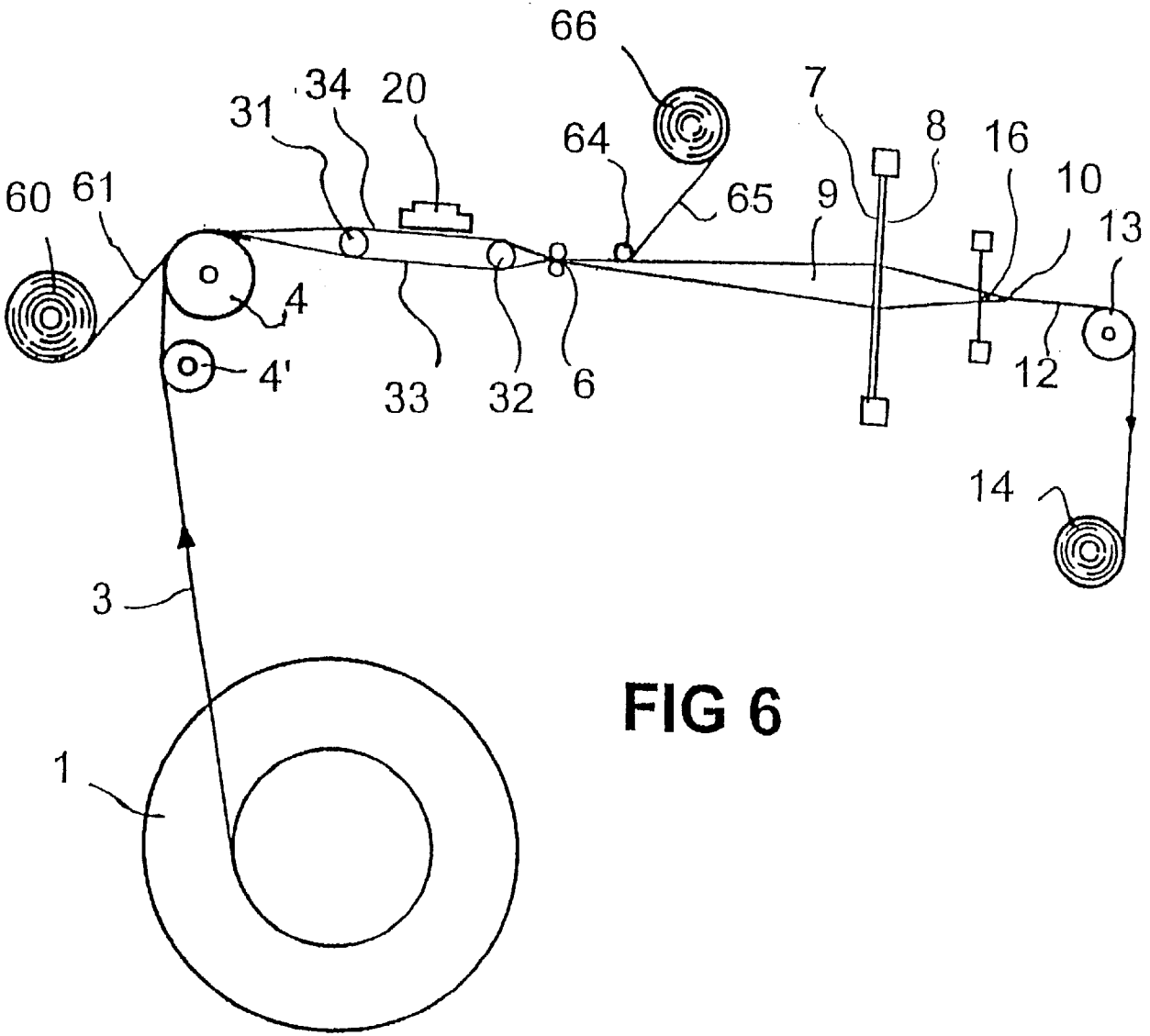
FIG. 6 is a side view of a loom operating using an alternative method of implementing the process according to the invention, intended to produce striped patterns on a fabric.
Figure 7:
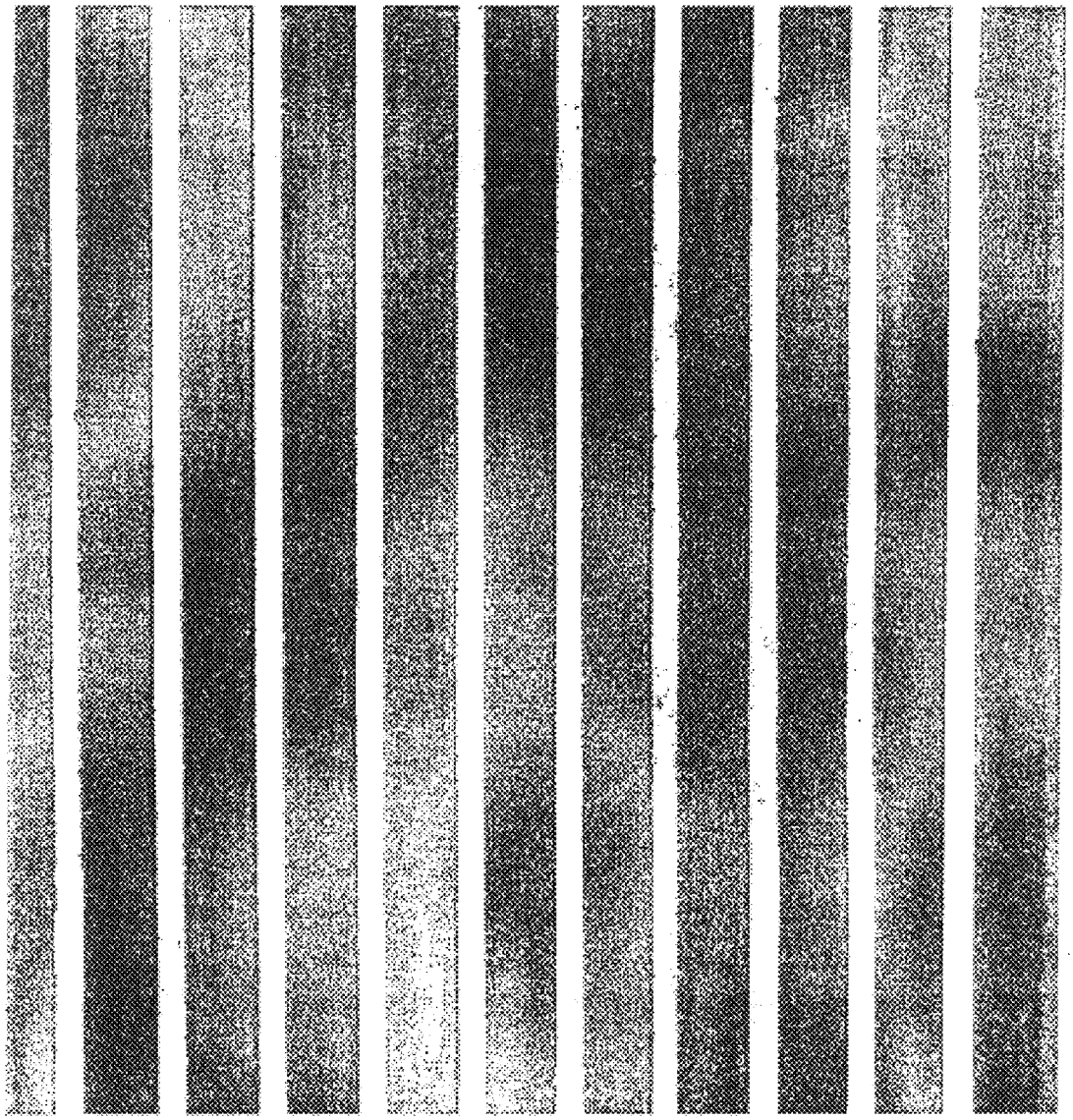
FIG. 7 is a photograph of a specimen of the fabric obtained by means of the loom in FIG. 6.

As already stated, the invention may also advantageously be implemented in order to produce striped fabrics, using the technique of sublimation of dyes borne by a transfer paper. In this case, the loom used may be that illustrated in FIG. 6, in which the sheet of warp yarns (3) is unwound in a known manner from its warp beam (2), passing over a set of turn rollers (4, 4').

In a known manner, after having passed through the characteristic region of the invention intended to produce printing, the warp enters frames, comprising the healds (7, 8), and then the beating comb (11) which forms the fell point (10). The fabric (12) formed then passes over a turn roller (13) before being wound up on a storage roll (14).

The reference number (15) denotes the opening point of the shed.

In a known manner and as described in the aforementioned patent EP 0 461 048, incorporated hereinbelow by reference, a reel (60) of transfer paper (61) bearing a suitable pattern is brought into contact with the warp (3), possibly by bearing on the turn roller (4).

In the immediate upstream neighborhood of the point of opening (15) of the shed (19), a heating pad (63), capable of undergoing an up-and-down motion, fixes, owing to the heat, the dye onto the warp which advances gently.

A turn bar (64) allows the exhausted transfer paper (65) to be recovered on a roller (66) synchronized with the advance of the loom.

The various aspects relating to the heating means used and all the possible variants are identical to those already described in patent EP 0 461 048 by the Applicant, corresponding to documents US 5 212 845 and US 5 377 509.

According to one characteristic of the present invention, the sheet of warp yarns (3) is separated into two portions (33, 34) so that only one portion of the warp yarns is printed by sublimation of the dyes present on the paper (61).

In practice, this separation is achieved by using two transverse bars (31, 32) positioned between the turn roller (4) and the bars (5, 6) defining the opening point (15) of the shed.

These two bars (31, 32), placed one after the other, make it possible to offset the two series of yarns (33, 34) and to maintain a gap between them.

Consequently, only the series (34) of yarns passing close to the pad (63) and coming into contact with the paper (61) is printed.

The yarns forming part of the series (34) coming into contact with the paper may be selected with complete freedom. This makes it possible, as illustrated in FIGS. 2 or 3, to obtain either patterns of perfectly identical stripes, when the segments (40, 45) all have the same or similar number of yarns, or to obtain variable effects, at will, when the bundles, (50, 55) have very different numbers of yarns (see FIG. 3).

As already stated, the yarns located at the edge of each of the bundles, when they come into contact with the paper (61) in the region opposite the pad (63), receive the sublimed dyes. It has been found that the yarns located at the edge of each of the bundles receive more dyes than the yarns located at the center of the bundle; it follows that when the printed yarns are brought together with the warp yarns of the series (33), an overly colored region is visible within these particular yarns.

The stripe thus obtained therefore has a particularly perceptible crimp effect.

Many variations are, of course, possible using transfer papers having patterns which, when combined with the striped effect obtained according to the process of the invention, multiply the visual effects.

In particular, it is possible to use transfer papers (61) which themselves have a succession of longitudinal stripes. When the stripes on the transfer paper are arranged in such a way that their boundary between two adjacent stripes is imprinted on the series (34) of the warp yarns selected, the stripes thus obtained have at least two colors, or even a mixture of two colors, when they are continuous.

It is apparent from the foregoing that the process according to the invention has many advantageous, and it makes it possible, in particular:

- to obtain stripes which are perfectly straight and able to reproduce a wide variety of patterns;
- to modify very easily the width of the stripes chosen, while operating with a single warp beam just by a single modification to the distribution of the warp yarns that have to be printed.

The cloth according to the invention is particularly novel, as it has perfectly straight stripes with boundaries limited to a single yarn, while still being able to have an extremely wide variety of patterns.

It is also possible to combine the two effects, namely embossing and coloring of the stripes, to obtain a cloth whose embossed parts are colored.

It goes without saying that there will be no difficulty for a person skilled in the art to transpose the invention to warp knitting machines, and the invention therefore also embraces the fabrics knitted on a "warp knitting machine" which are obtained according to the same principle.

It is apparent from the foregoing that the process according to the invention, through the simplicity of the means that it uses, allows very great versatility, economic and easy manufacture of a very wide variety of cloth without any special modification of the simplest loom.

What is claimed is:

1. A process for heat treating warp yarns in a loom during a weaving process, the process comprising:

unwinding a sheet of parallel warp yarns (3) from a single warp beam(1);

passing said sheet over a back-rest roller (4);

forming a shed (9) by means of healds (7,8), said shed being defined, in the direction of advance of the warp, at the entrance of the shed by an opening point (15) and on the other side by a fell point (10);

inserting a weft yarn (16) into the shed in the vicinity of the fell point (10) in order to form a cloth; and pulling and uniformly winding up the cloth;

wherein the process further comprises heating only a portion of the warp yarns (3) and cooling the warp yarns;

and further comprising, after passing the sheet over the back-rest roller, separating the sheet into two series of yarns (33, 34) and maintaining a gap between the two series of yarns (33, 34) wherein only one of the two series of yarns is subjected to the heating operation.

2. The process as claimed in claim 1, wherein the heating is carried out on the warp yarns at a temperature high enough to cause an elongation and a local reduction in the elastic modulus thereof.

3. The process as claimed in claim 2, wherein the process further comprises a subsequent heat treatment step or a treatment in a free state.

4. The process as claimed in claim 3, wherein the treatment in the free state comprises a scalding step.

5. The process as claimed in claim 2, wherein the process further comprises a calendering step.

6. A textile cloth obtained according to the process as claimed in claim 1.

7. The textile cloth as recited in claim 6, wherein the warp yarns are crepe yarns.

8. The textile cloth as recited in claim 6, wherein the textile cloth comprises several different weft yarns.

9. The process as claimed in claim 1, further comprising contacting only the heated portion of the warp yarns with a transfer paper, the transfer paper carrying dye patterns, wherein the transfer paper moves in speed relationship with the warp yarns and wherein the dye patterns are transferred only to the heated warp yarns.

10. The process as claimed in claim 9, wherein the transfer paper comprises a pattern of parallel stripes in the direction of run of the paper and in that at least one of the boundaries of said stripes is brought close to that portion of the warp yarns on which the printing takes place.

11. A woven cloth obtained according to the process of claim 9, wherein the cloth comprises a plurality of parallel stripes.

12. The cloth as claimed in claim 11, wherein each stripe has selvedges where the intensity of the shade is higher than the rest of the stripe.

13. The cloth as claimed in claim 11, wherein at least one of the stripes has at least shades.

14. The process as claimed in claim 1, wherein the heating operation is practiced in the vicinity of the opening point of the shed.

15. The process as claimed in claim 1, wherein the cooling of the warp yarns is practiced in the shed before the warp yarns reach the healds.

16. A textile cloth obtained according to the process of claim 9, wherein the cloth comprises a plurality of parallel stripes and wherein each stripe has selvedges wherein the intensity of the shade is higher than the rest of the stripe.

17. The process as claimed in claim 1, wherein heating only a portion of the warp yarns is practiced prior to forming the shed.

18. A process for heat treating warp yarns in a loom during a weaving process, the process comprising:

unwinding a sheet of parallel warp yarns (3) from a single warp beam(1);

passing said sheet over a back-rest roller (4);

forming a shed (9) by means of healds (7,8), said shed being defined, in the direction of advance of the warp, at the entrance of the shed by an opening point (15) and on the other side by a fell point (10);

inserting a weft yarn(16) into the shed in the vicinity of the fell point (10) in order to form a cloth; and pulling and uniformly winding up the cloth;

wherein the process further comprises heating only a portion of the warp yarns (3) and cooling the warp yarns;

wherein the heating is carried out on the warp yarns at a temperature high enough to cause an elongation and a local reduction in the elastic modulus thereof, and wherein the process further comprises a subsequent heat treatment step or a treatment in a free state.

19. The process as claimed in claim 18, wherein the treatment in the free state comprises a scalding step.

20. A process for heat treating warp yarns in a loom during a weaving process, the process comprising:

unwinding a sheet of parallel warp yarns (3) from a single warp beam(1);

passing said sheet over a back-rest roller (4);

forming a shed (9) by means of healds (7,8), said shed being defined, in the direction of advance of the warp, at the entrance of the shed by an opening point (15) and on the other side by a fell point (10);

inserting a weft yarn (16) into the shed in the vicinity of the fell point (10) in order to form a cloth; and pulling and uniformly winding up the cloth;

wherein the process further comprises heating only a portion of the warp yarns (3) and cooling the warp yarns, and wherein the process further comprises a calendaring step.

21. A textile cloth obtained according to a process comprising:

unwinding a sheet of parallel warp yarns (3) from a single warp beam(1), passing said sheet over a back-rest roller (4);

forming a shed (9) by means of healds (7,8), said shed being defined, in the direction of advance of the warp, at the entrance of the shed by an opening point (15) and on the other side by a fell point (10); inserting a weft yarn(16) into the shed in the vicinity of the fell point (10) in order to form a cloth; and pulling and uniformly winding up the cloth;

wherein the process further comprises heating only a portion of the warp yarns (3) and cooling the warp yarns, and wherein the warp yarns are crepe yarns.

22. The textile cloth as recited in claim 21, wherein the textile cloth comprises several different weft yarns.

23. A process for heat treating warp yarns in a loom during a weaving process, the process comprising:

unwinding a sheet of parallel warp yarns (3) from a single warp beam(1);

passing said sheet over a back-rest roller (4);

forming a shed (9) by means of healds (7,8), said shed being defined, in the direction of advance of the warp, at the entrance of the shed by an opening point (15) and on the other side by a fell point (10);

inserting a weft yarn (16) into the shed in the vicinity of the fell point (10) in order to form a cloth; and pulling and uniformly winding up the cloth;

wherein the process further comprises heating only a portion of the warp yarns (3) and cooling the warp yarns; and further comprising contacting only the heated portion of the warp yarns with a transfer paper, the transfer paper carrying dye patterns, wherein the transfer paper moves in speed relationship with the warp yarns and wherein the dye patterns are transferred only to the heated warp yarns; and wherein the transfer paper comprises a pattern of parallel stripes in the direction of run of the paper and in that at least one of the boundaries of said stripes is brought close to that portion of the warp yarns on which the printing takes place.

24. A woven cloth obtained according to the process of claim 23, wherein the cloth comprises a plurality of parallel stripes.

25. The cloth as claimed in claim 24, wherein each stripe has selvedges where the intensity of the shade is higher than the rest of the stripe.

26. The cloth as claimed in claim 24, wherein at least one of the stripes has at least two shades.

* * * * *

UNITED STATES PATENT AND TRADEMARK OFFICE

CERTIFICATE OF CORRECTION

PATENT NO. : 6,520,216 B2 
DATED : February 18, 2003
INVENTOR(S) : Corbiere

It is certified that error appears in the above-identified patent and that said Letters Patent is hereby corrected as shown below:

Title page,
Item [54], delete "PROCESS FOR OBTAINING A WOVEN CLOTH" and insert -- PROCESS FOR HEAT TREATING WARP YARNS IN A LOOM DURING WEAVING --

Signed and Sealed this

Thirtieth Day of September, 2003

JAMES E. ROGAN
*Director of the United States Patent and Trademark Office*